United States Patent [19]

Baril et al.

[11] 4,305,052

[45] Dec. 8, 1981

[54] ULTRA-HIGH-FREQUENCY DIODE PHASE SHIFTER USABLE WITH ELECTRONICALLY SCANNING ANTENNA

[75] Inventors: Michel Baril; Vu San Hoang, both of Paris, France

[73] Assignee: Thomson-CSF, Paris, France

[21] Appl. No.: 104,836

[22] Filed: Dec. 18, 1979

[30] Foreign Application Priority Data

Dec. 22, 1978 [FR] France ..... 78 36247

[51] Int. Cl.[3] ..... H01P 1/185

[52] U.S. Cl. ..... 333/164; 333/161; 333/246

[58] Field of Search ..... 333/156, 157, 160, 161, 333/164, 245, 246, 248, 103, 104, 26; 343/700 MS, 778, 854

[56] References Cited

U.S. PATENT DOCUMENTS

| | | | |
|---|---|---|---|
| 3,568,097 | 3/1971 | Hyltin | 333/161 |
| 3,916,349 | 10/1975 | Ranghelli et al. | 333/164 |
| 4,135,170 | 1/1979 | Baril et al. | 333/26 |
| 4,146,896 | 3/1979 | Baril et al. | 343/854 |

*Primary Examiner*—Marvin L. Nussbaum
*Attorney, Agent, or Firm*—Karl F. Ross

[57] ABSTRACT

A four-state phase shifter for UHF waves comprises two O-$\pi$ phase-shifting elements of planar structure on a common substrate, these phase-shifting elements including a symmetrical and an asymmetrical transmission line which can be selectively coupled in one of two ways by the alternate blocking and unblocking of respective diodes for a relative phase reversal. The two phase-shifting elements are linked by two further transmission lines of different propagation constants which can be selectively activated, again with the aid of diodes, and which may be disposed on opposite faces of the substrate or may form part of a coplanar conductor array on the same substrate face.

16 Claims, 7 Drawing Figures

ULTRA-HIGH-FREQUENCY DIODE PHASE SHIFTER USABLE WITH ELECTRONICALLY SCANNING ANTENNA

FIELD OF THE INVENTION

Our present invention relates to an ultra-high-frequency diode phase shifter in the form of a planar structure on a substrate with a high dielectric constant, designed to provide four phase states.

BACKGROUND OF THE INVENTION

There are various types of diode phase shifters using PIN-type diodes, e.g. interference phase shifters, having a high power response and a wide pass band, and line-section phase shifters such as the switching phase shifter which, compared with the above-mentioned type, has smaller overall dimensions and constant losses related to phase displacement. Interference and line-section phase shifters are suitable for planar structures and the choice of one or the other type is based on such criteria as the number of phase-displacement diodes, the standing-wave ratios, the insertion losses and the power response.

However, these prior-art phase shifters utilize transmission lines of specific lengths and consequently have phase displacement, loss and standing-wave-ratio characteristics which vary with frequency.

OBJECTS OF THE INVENTION

The general object of our present invention is to provide an ultra-high-frequency diode phase shifter designed to obviate the disadvantages referred to hereinbefore.

More particularly, our invention aims at combining the advantages of interference constructions, which readily provide constant phases but at the price of a large number of diodes, with those of line-section constructions which use few diodes but whose phase displacement varies in a linear manner in the envisaged frequency band.

SUMMARY OF THE INVENTION

A four-state phase shifter according to our invention comprises a dielectric substrate with planar conductors supported on at least one flat surface of that substrate, these conductors having parallel edges and forming a plurality of transmission paths with a common direction of propagation between an input end zone and an output end zone separated by an intermediate zone. The transmission paths constituted by these conductors include a first main line of symmetrical field structure in one end zone, a second main line of asymmetrical field structure in the other end zone, as well as a first connecting line of symmetrical field structure and a second connecting line of asymmetrical field structure traversing the intermediate zone, these connecting lines having electrical lengths so chosen as to give rise to a differential phase angle $\phi$ which differs significantly from 0 , $\pi$ and any multiple thereof. At a junction of the intermediate zone with the end zone containing the first main line we provide first diode means with biasing means for selectively coupling the first main line to the first connecting line in a first and a second operating mode and to the second connecting line with relative phase inversion in a third and a fourth operating mode, respectively. At the junction of the intermediate zone with the other end zone containing the second main line we provide second diode means with biasing means for selectively coupling the first connecting line to the second main line with relative phase inversion in the first and second operating modes, respectively, and coupling the second connecting line to the second main line in the remaining operating modes. In this way, microwave energy is transmitted from the input zone to the output zone with a phase difference $\pi$ between the first and second operating modes, with a phase difference $\phi$ between the first and third operating modes and with a phase difference $\pi+\phi$ between the first and fourth operating modes, as more fully described hereinafter.

More particularly, the first main line and the first connecting line may respectively comprise a first and a second metal strip aligned with each other while the second main and connecting lines are formed by two metal layers, referred to hereinafter as ground-plane layers, which are separated by a slot in the end zone containing the second main line and by an extension of that slot in the intermediate zone. In the first and second operating modes the slot can be separated from its extension by a suitably biased short-circuiting diode forming part of the aforementioned second diode means.

The metal strips referred to may be disposed on one surface of a dielectric plate constituting the substrate whose opposite surface carries the aforementioned ground-plane layers which are conductively interconnected in the zone of the first main line; the two metal strips then form a pair of so-called microstrip lines. Alternatively, the strips and the ground-plane layers may be disposed on the same substrate surface to form a pair of so-called coplanar lines the second of which, as described below, can be converted into a so-called slot line merging into a similar line which constitutes the asymmetrical main line.

BRIEF DESCRIPTION OF THE DRAWING

The above and other features of our invention are described in greater detail hereinafter with reference to the attached drawing in which.

DETAILED DESCRIPTION

Let us briefly discuss what is meant by slot line, microstrip line and coplanar line, whose field configurations are different.

A slot line is a transmission line constituted by a slotted ground-plane layer deposited on a dielectric substrate serving as a mechanical support for the metallic conductors of that layer which is generally produced by photogravure or photolithography. This line has an asymmetrical field configuration.

In such a line almost all the energy is transmitted in the dielectric and is concentrated between the edges thereof. The thickness of the dielectric plate depends on the nature of its material and the width of the slot determines the characteristic impedance of the line.

A microstrip line has a dielectric plate placed between a metal strip and a metallic ground-plane layer. Here, again, almost all the energy is concentrated in the dielectric. This line has a symmetrical field configuration.

Figure 6:
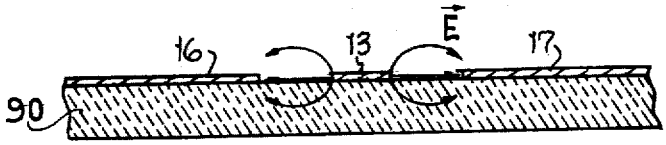
FIG. 6 is a cross-sectional view of a coplanar line operating in a transmission mode with symmetrical electrical-field configuration.

A coplanar line comprises a metal strip of limited width deposited on one surface of a dielectric plate and flanked by two conductive layers parallel thereto. When the dielectric constant is high, most of the energy is stored in the dielectric. The coplanar line can be used with either of two transmission modes, with a symmetrical or an asymmetrical configuration, as described hereinafter with reference to FIGS. 6 and 7.

Each of the phase shifters shown in the drawing comprises two $0-\pi$ phase-shifting elements of the type described in commonly owned French Pat. No. 2,379,196 and corresponding U.S. Pat. No. 4,146,896. With different combinations of biasing voltages applied to several diodes, the two phase-shifting elements can be selectively coupled to each other by an asymmetrical line or by a symmetrical line differing in their electrical lengths so as to give rise to a differential phase angle $\phi$ which is not 0, $\pi$ or a multiple thereof and which may be equal to $\pi/2$.

Figure 1:
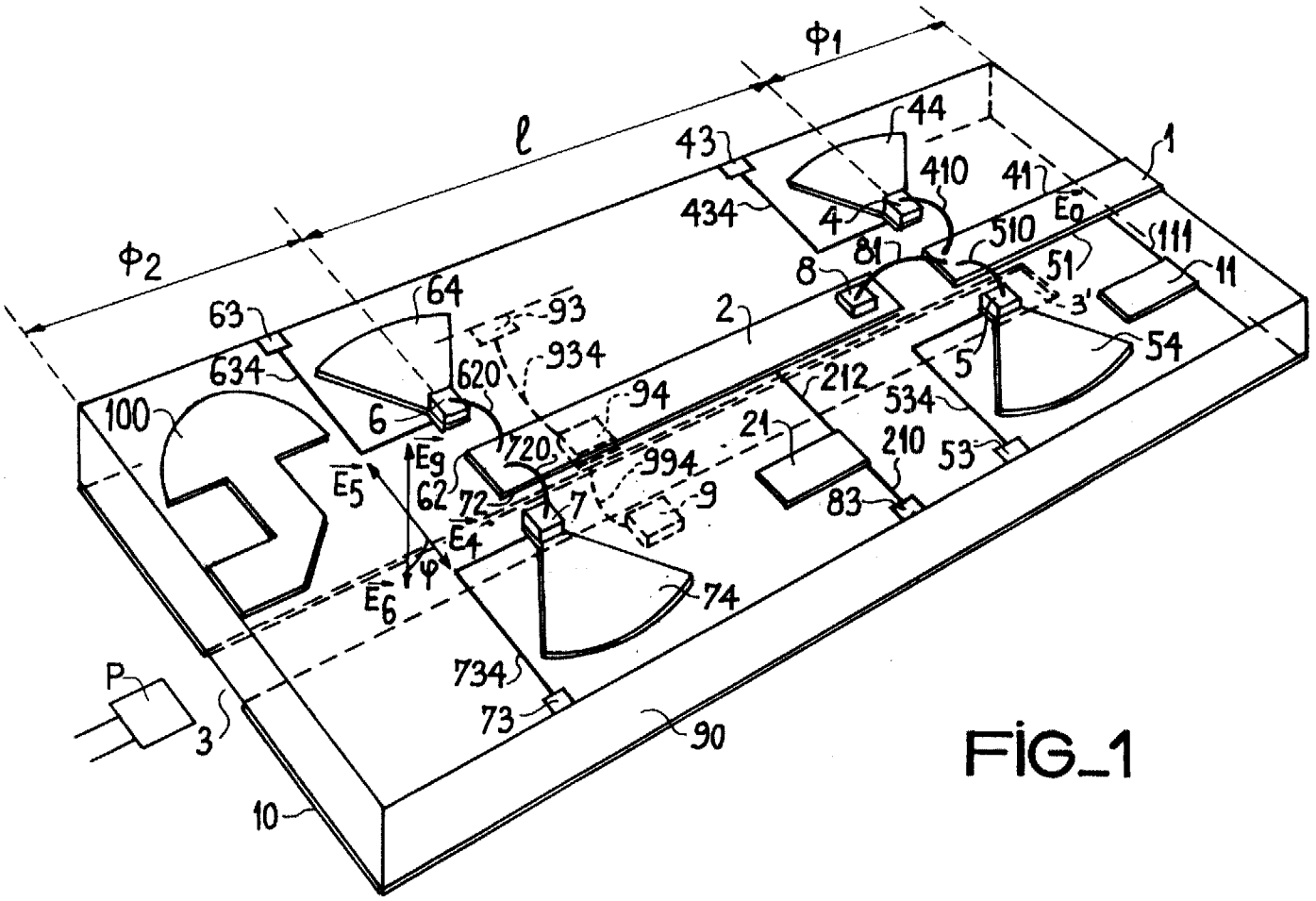
FIG. 1 is a perspective top view of a so-called two-bit phase shifter with four phase states, including a mircrostrip line and a slot line, embodying our invention.

FIG. 1 shows a two-bit diode phase shifter according to our invention comprising two ultra-high-frequency $0-\pi$ phase-shifting elements each including a slot line and a microstrip line which can be selectively interconnected by two lines of different field configuration forming respective extensions of the slot and microstrip lines. Thus, a main slot line 3 of one phase-shifting element has an extension 3' forming part of the other phase-shifting element which in turn includes a main microstrip line 1 extended by a microstrip line 2 which forms part of the first-mentioned element.

The microstrip lines 1 and 2, whose longitudinal axes coincide, are obtained by depositing a conductive strip of a certain length on one surface of a ceramic substrate 90 in the form of a rectangular plate whose opposite surface carries a ground-plane layer 10. Slot 3, 3' is cut in this layer 10 and its transmission axis is parallel to the longitudinal axes of microstrip lines 1 and 2 and defines with them a plane which is orthogonal to the planes of the lines. Matching between the lines is obtained on the one hand by the fact that the slot extension 3' overlaps the microstrip line 1 by a quarter wavelength $\lambda/4$ and on the other hand by the fact that slot 3, separated from its extension 3' by a short-circuiting lead 994 under the control of a diode 9, is also overlapped for a distance close to $\lambda/4$ by the free end of the microstrip line 2.

Figure 3:
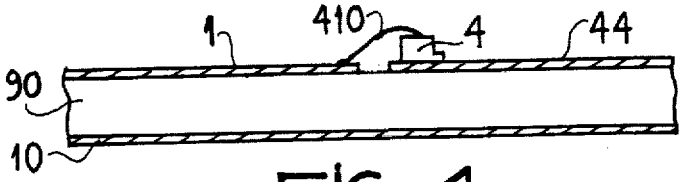
FIG. 3 is a sectional view of the phase shifter of FIG. 1.

Main microstrip line 1 is flanked by two diodes 4 and 5, generally of te PIN type. One of the terminals of diode 4 is brazed (see also FIG. 3) to an open-circuited quarter-wavelength microstrip line 44 on the face of substrate 90 carrying the microstrip lines 1 and 2 and is also connected by a conductor 434 to a source 43 of biasing voltage. The other terminal of diode 4 is connected to an edge 41 of microstrip line 1 by a conductor 410. An identical arrangement is provided for diodes 5, 6 and 7 each having one terminal joined on the one hand to an open-circuited quarter-wavelength microstrip line 54, 64 and 74 and on the other hand to conductors 534, 634 and 734 leading to respective sources 53, 63 and 73 of biasing voltage, their other terminals being respectively connected to edges 51, 62 and 72 of microstrip lines 1 and 2 by conductors 510, 620 and 720. The ultra-high-frequency matching of the microstrip line 1 is effected by an open-circuited quarter-wavelength line 11, placed at a distance $\lambda/4$ from line 1 and connected thereto by a lead 111. This ancillary quarter-wavelength line 11, equivalent in ultra-high frequency to a short-circuit in its plane, establishes an infinite impedance between microstrip line 1 and ground-plane layer 10. An ancillary quarter-wavelength line 21 is similarly connected to microstrip line 2 by a lead 212.

It should be noted that the diodes can be fixed directly by brazing to the microstrip lines 1 and 2, if the dimensions of the latter permit this, and can be connected to the sectoral quarter-wavelength lines 44, 54, 64, 74 by respective conductors.

In order to enable energy transmission between microstrip lines 1 and 2, a diode 8 is fixed directly by brazing to line 2 and is connected to line 1 via a conductor 81. The biasing of this diode is effected by means of a voltage source 83 via an extension 210 of lead 212.

Diode 9, brazed to the underside of ground-plane layer 10, is connected by the short-circuiting lead 994 to a capacitor 94 and to a bias-voltage source 93 by a conductor 934.

For collecting the output signal of the phase shifter of FIG. 1, whose input end is assumed to be the microstrip 1, we prefer to use a coaxial connection P which can be more conveniently coupled to a microstrip line than to a slot line, owing to the radial orientation of the field lines in such a coaxial connection. It is for this reason that the main slot line 3 is coupled at its output end to an additional microstrip line 100 on the opposite face of dielectric body 90 to which the microwave energy transmitted in the slot line is transferred.

As described in the aformentioned prior U.S. Pat. No. 4,146,896, each sectoral quarter-wavelength microstrip line 44, 54, 64 or 74 is equivalent to a short circuit between the corresponding edge of the associated microstrip line and an edge of the underlying slot line. Thus, an electrical field $\vec{E}$ perpendicular to the microstrip line 1 or 2 induces an electrical field across slot 3, 3'.

We shall now describe the different phase states which can be obtained by means of the phase shifter according to our invention. FIG. 1 shows the electrical lengths $\Phi_1$ and $\Phi_2$ of the two end zones supporting the $0-\pi$ phase-shifting elements in which the phase shift is constant. Diodes 4, 5, 6, 7, 8 and 9 can be considered, in a first approximation and in accordance with the applied biasing voltage, either as a near short circuit equivalent to a low-value inductance or as a near open circuit equivalent to a low-value capacitance.

Under these conditions, the state 0 is defined by a reverse biasing of diodes 5, 6, 7, 8 and 9 and a forward biasing of diode 4. Thus, microstrip line 1 is connected by conductive diode 4 to the slot line 3, as described hereinbefore. As diode 8 between microstrip lines 1 and 2 is blocked, the incoming UHF energy is not transmitted in the microstrip line 2 but in the slot line 3. The electrical field $\vec{E}_0$ applied to the microstrip line 1 induces in the slot line 3 an electrical field $E_4$ in a given direction; this field is at a maximum since the closed end of the slot line 3' lies at a distance of approximately $\lambda/4$ beneath the microstrip line. The blocking of diodes 6 and 7 prevents any coupling between the microstrip line 2 and the slot line 3. The transmission phase is then:

$$\Phi_0=\Phi_1+\beta_2\cdot l+\Phi_2$$

because the microwave energy is transmitted over an intermediate zone of length l by slot line 3, 3' whose phase constant is $\beta_2$.

The state $\phi$ is defined by the reverse biasing of diodes 4, 5 and 7 and the forward biasing of diodes 6, 8 and 9. In this case, the first $0-\pi$ phase-shifting element 1, 3' does not operate and, as diode 8 is conductive, the incoming energy is transmitted from microstrip line 1 to connecting line 2 up to the conductive diode 6 where it is transferred to the main slot line 3. The conducting diode 9 short-circuits the slot line 3 at a distance $\lambda/4$ from the free end of microstrip line 2 and ensures the matching thereof while cutting off the slot 3'. The electrical field $\vec{E}_6$ created in the slot line 3 is of the same value as $\vec{E}_4$, but their vectors include between them an angle $\phi$ as indicated diagrammatically.

In this instance the transmission phase is $\phi_\phi=\Phi_1+\beta_1\cdot l+\Phi_2$ because the microwave energy is transmitted over a length l of the microstrip line 2 of phase constant $\beta_1$.

The differential phase shift compared with state 0 is therefore:

$$\Delta\Phi=\Phi_\phi-\Phi_0=(\Phi_1+\beta_1\cdot l+\Phi_2)-(\Phi_1+\beta_2\cdot l+\Phi_2)=(\beta_1-\beta_2)\cdot l$$

The third state $\pi$ functions in the same way as state 0, but with diode 5 conducting instead of diode 4. Thus, in slot line 3 the electrical field $\vec{E}_5$ has a value identical to $\vec{E}_4$, but its direction is reversed.

The differential phase shift compared with state 0 is:

$$\Delta\Phi=\pi$$

Finally, the last state $\phi+\pi$ functions like the state $\phi$ but with diode 7 conducting instead of diode 6. The electrical field $\vec{E}_9$ created in the slot line 3 has a value identical to $\vec{E}_6$, but its direction is reversed.

Consequently, the differential phase shift compared with state 0 is:

$$\Delta\Phi=(\beta_1-\beta_2)\cdot l+\pi$$

Figure 2:
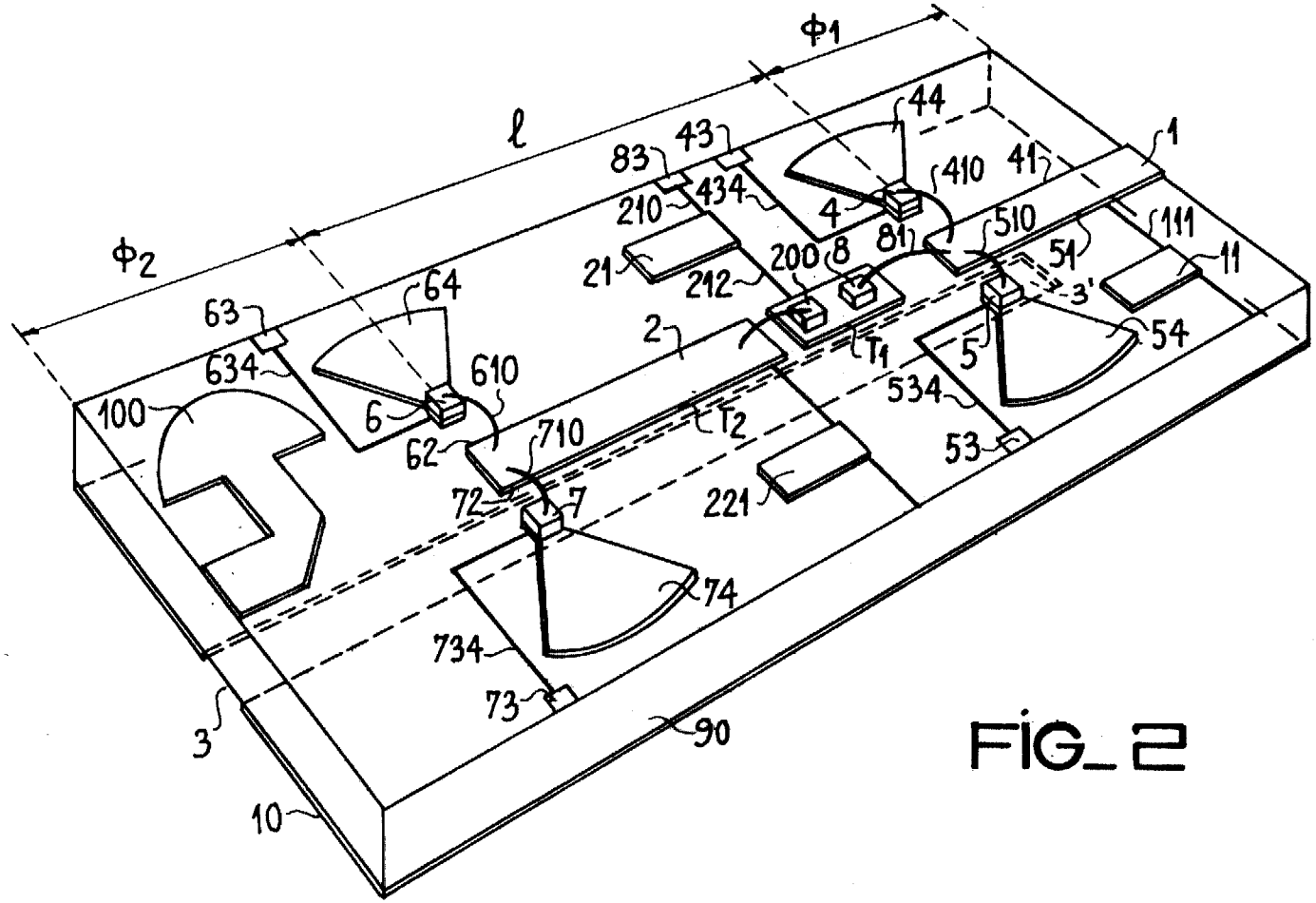
FIG. 2 is a similar view of another two-bit phase shifter according to our invention, again including a microstrip line and a slot line.

A modification of the phase shifter of FIG. 1 is shown in FIG. 2 in which the microstrip line 2 is divided into two separate sections $T_1$ and $T_2$. The ultra-high-frequency connection between these two sections is provided by a high-value capacitor 200 which isolates the two sections for direct current, thereby preventing any parasitic propagation of control signals from the diodes. The biasing of diode 8 is effected as before by means of leads 210, 212 connected to open-circuited line 21 and to voltage source 83. The ultra-high-frequency matching of the second section $T_2$ of microstrip line 2 is ensured by a similar open-circuited quarter-wavelength line 221 placed at a distance $\lambda/4$ from line 2.

Figure 4:
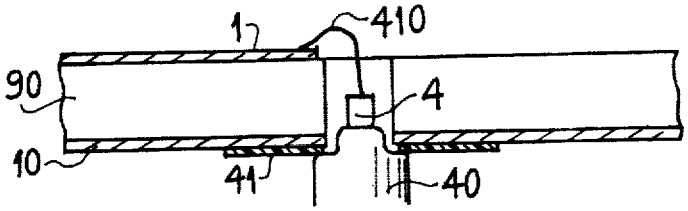
FIG. 4 is a view similar to FIG. 3, showing a modification of the phase shifter of FIG. 1.

In a modified structure shown in section in FIG. 4, the quarter-wavelength line 44 is eliminated and contact with the slot line is provided by way of substrate 90. In this embodiment, the substrate is perforated at the end of microstrip line 1. This perforation accommodates the diode 4 which is carried on a base 40 serving for biasing same. A dielectric disk 41, which is metallized on both faces, is brazed to the grounded layer 10 and to the diode base 40. Conductor 410 directly connects an electrode of the diode to an edge of the microstrip line 1.

Figure 5:
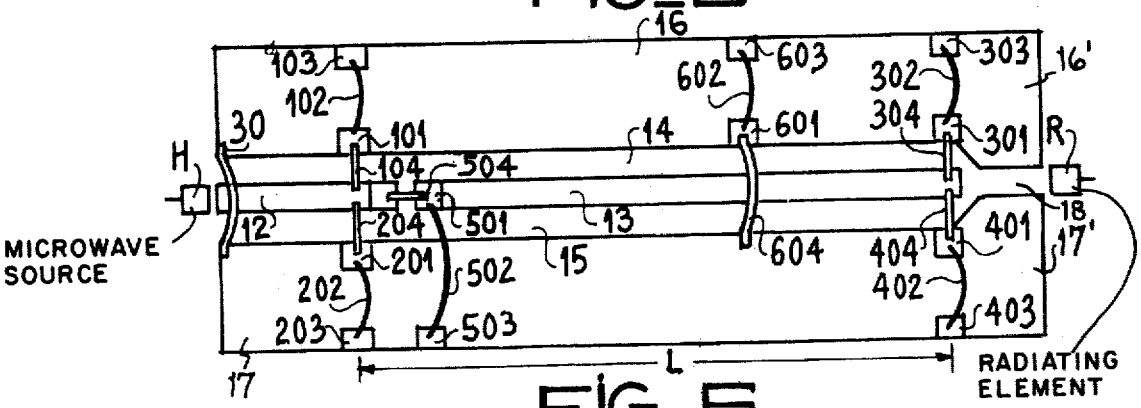
FIG. 5 is a plan view of a two-bit phase shifter according to our invention including a coplanar line and a slot line.

FIG. 5 shows another embodiment of a two-bit diode phase shifter according to our invention comprising two $0-\pi$ phase-shifting elements realized in part with the aid of a main coplanar line and interconnected by a section of that line capable of being operated as a slot line. This coplanar line is formed by a central metallic strip 12 with an extension 13, separated by respective slots 14 and 15 from two metallic ground-plane layers 16 and 17 on the same surface of ceramic substrate 90 (see also FIGS. 6 and 7). Layers 16 and 17 are interconnected at the input end of the main coplanar line by a conductor 30.

Figure 7:
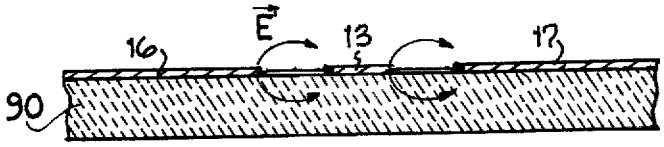
FIG. 7 is a view similar to FIG. 6, showing a coplanar line operating in a transmission mode with an asymmetrical electrical-field configuration.

The connecting coplanar line including strip 13 is able to operate in one symmetrical and two asymmetrical transmission modes, with a phase constant $\gamma_1$ for the symmetrical mode (FIG. 6) and $\gamma_2$ for the asymmetrical mode (FIG. 7). Thus, when the central conductor 12 is connected to layer 16 or 17 by a short-circuiting jumper 104 or 204, these layers operate as a slot line whose field spans the two slots 14 and 15. Here, again, matching is obtained between the lines by the fact that on the one hand the slot line 14, 15 joins the main coplanar line 12 at a distance close to $\lambda/4$ from conductor 30 and on the other hand a diode 601 can short-circuit the layers 16 and 17 at a distance close to $\lambda/4$ from the free end of coplanar line 13 where slots 14, 15 merge into a slot 18 bounded by extensions 16', 17' of these layers.

As in the phase shifter of FIG. 1, there is again provided a set of diodes 101, 201, 301, 401, 501 and 601 connected on the one hand by respective conductors 102, 202, 302, 402, 502 and 602 to bias-voltage sources 103, 203, 303, 403, 503 and 603 and on the other hand to lines 12 and 13 by respective conductors 104, 204, 304, 404 and 504 and to the grounded layer 17 by a conductor 604. To explain the operation of this two-bit phase shifter, the different phase states which can be obtained thereby will now be discussed.

State 0 is defined by the reverse biasing of diodes 201, 301, 401, 501 and 601 and the forward biasing of diode 101. Thus, coplanar line 12 is at the same potential as the layer 16 at the location of diode 101, whereby an asymmetrical field configuration is excited across slot 15 between the locations of diode 101 and diodes 301, 401. Between these two locations the transmission phase is:

$$\Phi_0=\gamma_2\cdot L$$

because the microwave energy is transmitted over a length L of the asymmetrical line whose phase constant is $\gamma_2$.

The state $\phi$ is defined by the reverse biasing of diodes 101, 201 and 401 and the forward biasing of diodes 301, 501 and 601. The first phase-shifting element including line 12 does not function and, as diode 501 is conducting, the microwave energy is transmitted from coplanar line 12 to coplanar line 13 up to the location of conducting diodes 301, 401 where the field becomes asymmetrical as it enters the slot line 18. In this instance the transmission phase is:

$$\Phi_\phi=\gamma_1\cdot L$$

because the microwave energy is transmitted over a length L of the symmetrical line.

Compared with the state 0, the differential phase shift is:

$$\Delta\Phi = \Phi_\phi - \Phi_0 = (\gamma_1 - \gamma_2)\cdot L$$

The third state $\pi$ is defined in the same way as state 0, but with diode 201 conducting instead of diode 101. Thus, coplanar line 12 is shorted to layer 17 at the location of diode 201 whereby an asymmetrical mode in phase opposition to that of state 0 is excited across slot 14. Compared with state 0, the differential phase shift is:

$$\Delta\Phi = (\gamma_1 \cdot L + \pi) - \gamma_1 \cdot L = \pi$$

Finally, the last state $\phi + \pi$ is established like state $\phi$ but with diode 401 conducting in place of diode 301. The energy is transmitted from coplanar line 12 via coplanar line 13 to slot line 18. The transmission phase is:

$$\phi_{\phi+\pi} = \gamma_2 \cdot L + \pi$$

and the differential phase shift compared with state 0 is:

$$\Delta\phi = (\gamma_1 - \gamma_2)\cdot L + \pi$$

In these three embodiments of our phase shifter a special case should be noted, namely that where $\phi = \pi/2$, making it possible to obtain the four symmetrical phase shifts 0, $\pi/2$, $\pi$, $3\pi/2$. Phase shift $\phi = \pi/2$ is obtained when the two $0-\pi$ phase-shifting elements are alternately connectable by lines of different electrical field configurations of length l or L whose phase constants $\beta_1$ and $\beta_2$ or $\gamma_1$ and $\gamma_2$ are such that $(\beta_1 - \beta_2)\cdot l = \pi/2$ or $(\gamma_1 - \gamma_2)\cdot L = \pi/2$.

It should be noted that, in the embodiments described, the width of the strip, the width of the slot and the thickness of the substrate are dependent on the characteristic impedance of the transmission line upstream and downstream of the location of the diodes. With suitable choice of these parameters, a maximum power can be transmitted with a low standing-wave ratio which can be close to 1.

Such four-state phase shifters of low phase variation, attenuation and standing-wave ratio in a wide frequency band are advantageously used in electronically scanning antennas wherein, a shown by way of example in FIG. 5, a radiating element R is connected to the output slot line 18 while the coplanar input line 12 is coupled to a power supply H.

What is claimed is:

1. A four-state phase shifter for ultra-high-frequency waves comprising:

a dielectric substrate with at least one flat surface supporting an array of planar conductors with parallel edges forming a plurality of UHF transmission paths with a common direction of propagation between an input end zone and an output end zone separated by an intermediate zone, said transmission paths including a first main line of symmetrical field structure in one of said end zones, a second main line of asymmetrical field structure in the other of said end zones, a first connecting line of symmetrical field structure traversing said intermediate zone, and a second connecting line of asymmetrical field structure traversing said intermediate zone, said connecting lines having electrical lengths giving rise to a differential phase angle $\phi$ differing significantly from 0, $\pi$ and any multiple thereof;

first diode means at a junction of said one of said end zones with said intermediate zone provided with biasing means for selectively coupling said first main line to said first connecting line in a first and a second operating mode and to said second connecting line with relative phase inversion in a third and a fourth operating mode, respectively; and second diode means at a junction of said other of said end zones with said intermediate zone provided with biasing means for selectively coupling said first connecting line to said second main line with relative phase inversion in said first and second operating modes, respectively, and coupling said second connecting line to said second main line in said third and fourth operating modes, thereby transmitting microwave energy from said input zone to said output zone with a phase difference $\pi$ between said first and second operating modes, a phase difference $\phi$ between said first and third operating modes and a phase difference $\pi + \phi$ between said first and fourth operating modes.

2. A phase shifter as defined in claim 1 wherein said first main line comprises a first metal strip and said first connecting line comprises a second metal strip aligned with said first metal strip, said second main and connecting lines being formed by two metal layers separated by a slot in said other of said end zones and by an extension of said slot in said intermediate zone.

3. A phase shifter as defined in claim 2 wherein said substrate is a ceramic plate, said metal strips being disposed on one surface of said plate, said metal layers being disposed on the other surface of said plate and being conductively interconnected in said one of said end zones, said slot and said extension thereof being bisected by a plane perpendicular to said surfaces also bisecting said strips.

4. A phase shifter as defined in claim 3 wherein said second diode means includes a short-circuiting diode biasable to separate said slot from said extension in said first and second operating modes.

5. A phase shifter as defined in claim 4 wherein said slot overlaps said second metal strip and said extension overlaps said first metal strip by approximately a quarter wavelength at an ultra-high operating frequency.

6. A phase shifter as defined in claim 3, 4, or 5 wherein said first diode means includes a pair of diodes alternately biasable to couple said first metal strip to either of said metal layers, said second diode means including a pair of diodes alternately biasable to couple said second metal strip to either of said metal layers.

7. A phase shifter as defined in claim 6 wherein said first diode means further includes a diode biasable to establish a direct connection between said metal strips.

8. A phase shifter as defined in claim 7 wherein said second metal strip is divided into two aligned sections that are capacitively coupled to each other.

9. A phase shifter as defined in claim 3, 4, or 5 wherein each of said metal strips is conductively connected to an ancillary microstrip line on said one surface establishing a substantially infinite impedance between the respective metal strip and said metal layers.

10. A phase shifter as defined in claim 1 wherein said first main line comprises a first metal strip flanked by a pair of parallel metal layers and separated therefrom by respective lateral slots, said second main line being formed by extensions of said metal layers separated by a further slot, said first and second connecting lines being formed by a second metal strip in line with said first strip and separated from said metal layers by extensions of said lateral slots merging into said further slot, said metal layers being conductively interconnected in said one of said end zones.

11. A phase shifter as defined in claim 10 wherein said first diode means includes three diodes respectively biasable to couple said first metal strip to either of said metal layers and to said second metal strip, said second diode means including two other diodes respectively biasable to couple said second metal strip to either of said extensions of said metal layers.

12. A phase shifter as defined in claim 11 wherein said second diode means further includes a short-circuiting diode biasable to interconnect said metal layers at a location spaced from said other diodes by approximately a quarter wavelength at an ultra-high operating frequency.

13. A phase shifter as defined in claim 10, 11 or 12 wherein said first metal strip has a length of approximately a quarter wavelength at an ultra-high operating frequency.

14. A phase shifter as defined in claim 2, 3 or 4, further comprising a third metal strip on said one surface overlying said slot in said other of said end zones and forming with said metal layers a microstrip line for transmitting microwave energy from said second main line to an output connection.

15. A phase shifter as defined in claim 1, 2 or 10 wherein the difference in the electrical lengths of said connecting lines is such that $\phi=\pi/2$.

16. A phase shifter as defined in claim 1, 2 or 10 wherein said first main line lies in said input end zone and is coupled to a source of microwaves, said second main line lying in said output end zone and being coupled to a radiating element of an electronically scanning antenna.

* * * * *